United States Patent [19]

Fisher

[11] 4,320,253

[45] Mar. 16, 1982

[54] CERAMIC BEADS FOR HEATERS

[76] Inventor: Joseph Fisher, 52 Southover, Daisy Hill, Westhoughton, Bolton, Lanchasire, England

[21] Appl. No.: 182,661

[22] Filed: Aug. 29, 1980

Related U.S. Application Data

[63] Continuation of Ser. No. 79,060, Sep. 26, 1979, Pat. No. 4,255,649.

[30] Foreign Application Priority Data

Sep. 29, 1978 [GB] United Kingdom ..... 38749/78

[51] Int. Cl.[3] ..... H01B 17/56; H05B 3/02

[52] U.S. Cl. ..... 174/138 J; 174/111; 219/532; 219/536; 219/550; 338/213; 338/305; 338/317

[58] Field of Search ..... 219/532, 550, 536, 537, 219/542, 548; 174/137 R, 111, 138 J; 338/213, 214, 290, 303, 305, 317; D26/10; 13/25

[56] References Cited

U.S. PATENT DOCUMENTS

| | | | |
|---|---|---|---|
| D. 214,565 | 7/1969 | Toohill | 174/111 X |
| 1,855,092 | 4/1932 | Browne | 219/550 X |
| 2,061,350 | 11/1936 | Coupier et al. | 174/111 X |
| 2,121,283 | 6/1938 | Challet | 174/111 |
| 3,036,187 | 5/1962 | Goldstante et al. | 219/539 |
| 3,045,097 | 7/1962 | Sellars | 219/539 |
| 3,694,628 | 9/1972 | McGwire et al. | 219/550 |
| 3,806,706 | 4/1974 | Lodge | 219/550 |

FOREIGN PATENT DOCUMENTS

| | | | |
|---|---|---|---|
| 13390 | 4/1904 | Norway | 219/550 |
| 813508 | 5/1959 | United Kingdom | 219/550 |
| 1415002 | 11/1975 | United Kingdom | 219/550 |

*Primary Examiner*—Volodymyr Y. Mayewsky
*Attorney, Agent, or Firm*—Laurence R. Brown

[57] ABSTRACT

A heating element comprising a plurality of ceramic components strung together on a heating wire to form a flexible structure, adjacent ceramic components comprising integrally formed mating projections and depressions. The element comprises ceramic components of a type each having a body defining two generally parallel passages therethrough, both passages terminating at one end in a depression, one passage terminating at the other end in a depression and the other passage terminating at the other end in a projection.

2 Claims, 5 Drawing Figures

CERAMIC BEADS FOR HEATERS

Figure 1:
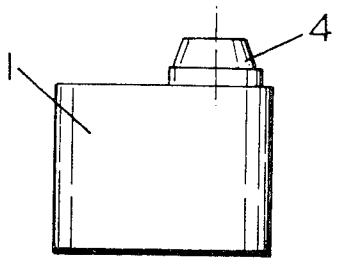

This application is a continuation of the copending application Ser. No. 79,060, filed Sept. 26, 1979 now issued as U.S. Pat. No. 4,255,649 of Mar. 10, 1981.

The present invention relates to the ceramic components.

British Pat. No. 893,125 (U.S. Pat. No. 3,036,187) describes a heating element in which small ovoid ceramic beads are arranged on the wire between adjacent blocks to improve flexibility without exposing the wire. The small beads do indeed improve flexibility but they cause handling difficulties during manufacture or subsequent modification to the heating element. To avoid these handling difficulties British Pat. No. 1,415,002 proposes the use of blocks having bead-shaped projections formed integrally therewith to provide the desired improved flexibility without using small ceramic components. The system described in British Pat. No. 1,415,002 does however require the provision of four different types of ceramic block (of which two different types of end pieces are required) to enable the assembly of generally rectangular heating elements and this increases the costs involved in obtaining, storing and assembling the ceramic components. The system according to specification 893,125 requires only three different ceramic component types including the small beads. However one end piece type is complex needing to have two pieces rivetted together. Narrow heating elements having only two rows of ceramic components can in fact be fabricated from only three of the components described in British Pat. No. 1,415,002, but such narrow elements can be fabricated from only two of the components described in British Pat. No. 893,125.

One object of the invention is to provide a ceramic component type which of itself can form said narrow heating elements.

It is an object of the present invention to provide a ceramic component type permitting heating elements to be manufactured easily from a minimum number of ceramic components, and in particular a ceramic component type providing a single type end piece that protects the wire.

According to the present invention, there is provided ceramic components which can be strung together on a heating wire to form a flexible structure with adjacent ceramic components comprising integrally formed mating projections and depressions, characterized in that the element comprises ceramic components of a type each having a body defining two generally parallel passages therethrough, both passages terminating at one end in a common slot, one passage terminating at the other end in a depression, and the other passage terminating at the other end in a projection.

It will be appreciated that a double row element can be manufactured using no more than two types of ceramic component, and a three or more row element can be manufactured using no more than three types of ceramic component.

When the element is assembled the interengaged projections and depressions can move relative to each other to enable the element to bend. The element can thus be fitted in close contact with for example curved surfaces.

Figure 2:
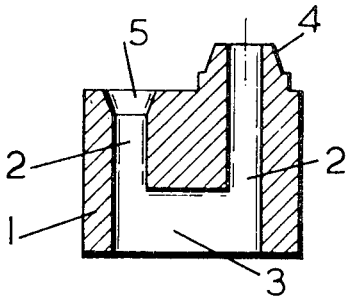
Figure 3:
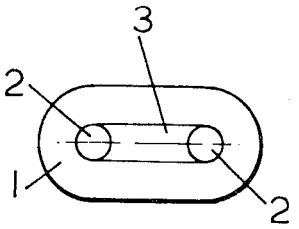
Figure 4:
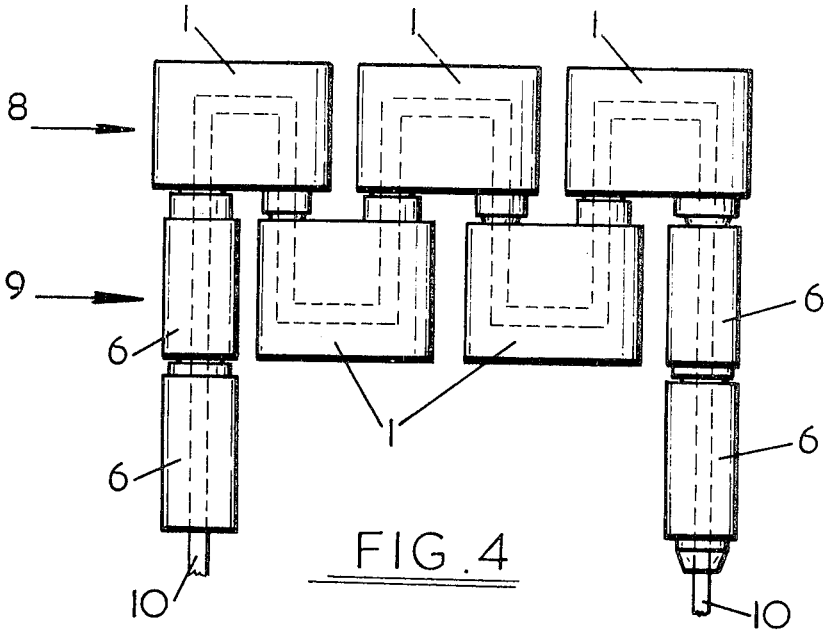
Figure 5:
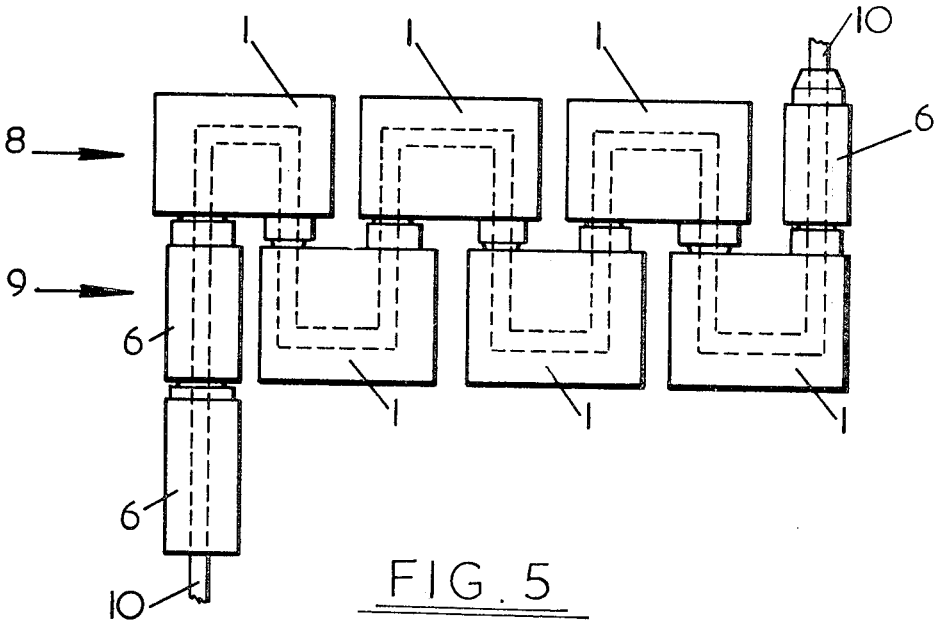

Embodiments of the present invention will now be described, by way of example, with reference to the accompanying drawings, in which:

FIGS. 1, 2 and 3 respectively show side, side sectional and bottom end views of the ceramic component;

FIGS. 4 and 5 show embodiments of the invention manufactured from components as shown in FIGS. 1 to 3.

Referring to FIGS. 1 to 3, the illustrated ceramic body 1 is of a type which comprises two passages 2 each of which terminates at one end in a common slot 3 and at the other end in a projection 4 or a depression 5. The projection 4 and depression 5 have matching frusto-conical axial sections.

Referring now to FIG. 4, the illustrated embodiment of the invention comprises a row 8 of three ceramic members 1 of the type of FIGS. 1 to 3, and a row 9 made up from two members 1 of this type. Thus the members 1 of the two rows 8 and 9 are staggered relative to each other, and bead members 6 may fill spaces at the ends of the row 9 which result from the fact that the row 8 has one more member 1 than the row 9. A wire 10 is passed via two further lead in members 6 along the path indicated by dotted lines to be protected inside the slots (3 FIG. 1) of elements 1.

Referring to FIG. 5, an alternative two row heating element is illustrated. This element is similar to that of FIG. 4 but row 8 has an extra bead member 6 and row 9 has an extra ceramic member 1 but only one bead member 6. The resulting structure differs from that of FIG. 4 in that the two ends of the wire 10 extend from opposite sides rather than from the same side.

The embodiments of the invention illustrated in FIGS. 4 and 5 which comprise only two rows of ceramic bodies are known as cross wound snake heaters. It will be noted that these embodiments are fabricated from not more than two types of ceramic bodies.

The interengagement of the projections and depressions in the assembled elements may be seen from FIGS. 4 and 5. Assembly is a simple matter not only because at most only two ceramic components are used, but also because the wire can be threaded through each component by always inserting the wire into the appropriate passage from its depression end. Therefore it is not necessary to think about the orientation of the individual components. Providing the components are selected in the correct order, the assembler merely inserts the wire into the depression end of a passage in the selected component and the correct orientation results automatically.

It will be appreciated that the use of a jig to hold the ceramic bodies will facilitate the insertion of the wire.

It will be appreciated that the shapes of the ceramic components may if desired differ from those illustrated. For example, the projections and depressions may be part-spherical rather than frusto-conical in axial section.

I claim:

1. An integral ceramic component for a heating element to be strung together on a heating wire to form a flexible structure, characterized in that the ceramic component is of a type having an integral ceramic body defining two generally parallel passages therethrough for receiving the heating wire, both passages terminating at one end in a common slot between the two passages and indented from the end for receiving the heating wire without protruding from the end, one said passage terminating at the other end from the slot in a depression adapted to receive in mating overlapping registration thereinto a projection of a further like ceramic component, and the other said passage terminating at the other end from the slot in a projection adapted to extend in overlapping mating registration into the said depression of a further like ceramic component.

2. An integral plurality of ceramic components as defined in claim 1 mated together and strung with a heating wire wherein a projection on one component is mated into the depression on another component and wherein the wire is threaded through both passages of each component and rests in said slots of each component.

* * * * *